US006186912B1

(12) United States Patent
Gait

(10) Patent No.: US 6,186,912 B1
(45) Date of Patent: Feb. 13, 2001

(54) APPARATUS AND METHOD FOR STRINGING LACROSSE STICKS

(75) Inventor: Paul J. Gait, Syracuse, NY (US)

(73) Assignee: Splax, L.L.C., Syracuse, NY (US)

( * ) Notice: Under 35 U.S.C. 154(b), the term of this patent shall be extended for 0 days.

(21) Appl. No.: 09/023,101

(22) Filed: Feb. 13, 1998

Related U.S. Application Data

(60) Provisional application No. 60/038,995, filed on Feb. 14, 1997.

(51) Int. Cl.[7] ..... A63B 59/02
(52) U.S. Cl. ..... 473/513; 473/553
(58) Field of Search ..... 473/513, 553, 473/556, 557, FOR 175, FOR 176, FOR 204, 42, 43

(56) References Cited

U.S. PATENT DOCUMENTS 239,931 * 4/1881 Bullock ..... 473/42
2,156,092 * 4/1939 Johnson ..... 473/557 X

* cited by examiner

*Primary Examiner*—Sam Rimell
(74) *Attorney, Agent, or Firm*—Dorsey & Whitney LLP

(57) ABSTRACT

An apparatus and method for stringing traditional pockets for a lacrosse stick is disclosed. The apparatus comprises a plurality of guides that hold thongs typically used in a traditional pocket of a lacrosse stick at any depth desired by a user and guides the user in the nylon placement during stringing. The guides can also be customized to produce a variety of different shaped pockets. The apparatus and method greatly decrease the skill required to install a high quality traditional pocket in a lacrosse stick. The apparatus and method also increase the consistency in the shape of the pocket. For example, the apparatus and method enable the user to replicate the same pocket for numerous lacrosse sticks because the depth of the thongs and the nylon placement are controlled. In other words, the apparatus and method remove the most influential variables associated with the installation of a traditional lacrosse pocket.

39 Claims, 21 Drawing Sheets

APPARATUS AND METHOD FOR STRINGING LACROSSE STICKS

This application claims benefit of Provisional application Ser. No. 60/038,995, Feb. 14, 1997.

BACKGROUND

Over the last thirty years the number of people playing lacrosse has increased dramatically. Today, in some locations, little league lacrosse is as popular as little league baseball, college teams are drawing over 30,000 people to a single game, and a professional league has been formed with teams in many of the largest cities around the United States.

As the sport has grown, the quality of play has also improved. Players are faster, stronger, and more skilled than ever before. Today, it is not uncommon for players to shoot a lacrosse ball in excess of 100 mph or pass behind their back with pin-point accuracy. As a result, the players are demanding more of their equipment. The old hand carved wooden sticks are no longer sufficient.

To satisfy this demand, companies have improved the design of lacrosse sticks. The old wooden sticks have been replaced by the combination of an aluminum or titanium handle and a plastic head. The new handles and heads are designed to decrease the stick's weight, increase its durability, and improve its overall performance. However, no one has designed an apparatus or method for stringing a traditional pocket for a lacrosse stick; let alone stringing a high quality traditional pocket consistently.

People have tried to improve the quality of the pockets by stringing the pockets with different materials or in different patterns, but none of these ideas have succeeded. For example, mesh pockets were created as an alternative to traditional pockets. Although mesh pockets are easier to string, these pockets do not provide the ball control, accurate passing, and fast shooting demanded by today's players. As a result, traditional pockets are still used in over 75% of all lacrosse sticks.

To obtain a quality lacrosse pocket, lacrosse players must buy the materials for a pocket separately from the stick and pay an expert to install the pocket because the pockets sold at retail stores are strung inconsistently (i.e., the nylon placement, tension, depth, and shape of the pocket are random). If a lacrosse player does not know an expert, they must suffer the consequences of using a pocket which provides inadequate ball control, passing accuracy, and shooting speed. In addition, even an expert cannot string the same pocket twice in the same way. Thus, every time a player uses a new pocket, it takes several weeks to become familiar with how that particular pocket passes and shoots. These inconsistent pockets are a significant problem because lacrosse sticks frequently break during the middle of a game.

What is needed is an apparatus and method for stringing a traditional lacrosse pocket consistently.

What is needed is an apparatus and method for stringing a traditional lacrosse pocket without requiring an expert.

What is needed is an apparatus and method for stringing a traditional lacrosse pocket that can be mass produced to satisfy the growing demand.

SUMMARY OF THE INVENTION

The present invention is a new apparatus and method for stringing traditional pockets for a lacrosse stick. The present invention uses a plurality of guides to hold the four thongs typically used in a traditional pocket at any depth desired by the user and guides the user in the nylon placement during stringing. The guides of the present invention can also be customized to produce a variety of different pockets. Thus, the present invention greatly decreases the skill required to install a high quality traditional pocket in a lacrosse stick.

The present invention also increases the consistency in the shape of the pocket. For example, if someone strings a traditional pocket with the present invention, the present invention enables the user to replicate the same pocket because the depth of the thongs and the nylon placement are controlled. In other words, the present invention removes the most influential variables associated with the installation of a traditional lacrosse product.

Consequently, lacrosse players will no longer be forced to become familiar with a different pocket shape every time their stick breaks. With the present invention, lacrosse players can prepare backup sticks with essentially identical pockets, allowing the players to pass and shoot as confidentially with their backup stick as they did with their primary stick.

In addition, the present invention also decreases the amount of time required to string a traditional pocket. By holding the thongs and dictating the nylon placement, the present invention frees the user's hands to weave the nylon.

As a result, lacrosse players will no longer have to buy a stick from a store, tear out the pocket, and pay an expert to string it properly. Using the present invention, any lacrosse player can consistently string high quality pockets. Or, if the present invention is adopted by lacrosse stick manufacturers, lacrosse players will be able to buy a stick strung by a manufacturer and use the stick immediately. The present invention works with any type of lacrosse head.

DESCRIPTION OF THE PREFERRED EMBODIMENT

To explain the present invention, the description of the preferred embodiment provides: a brief description of a traditional lacrosse pocket; a detailed description of the components within the present invention; and a detailed description of how to use the present invention, in that order.

Figure 1:
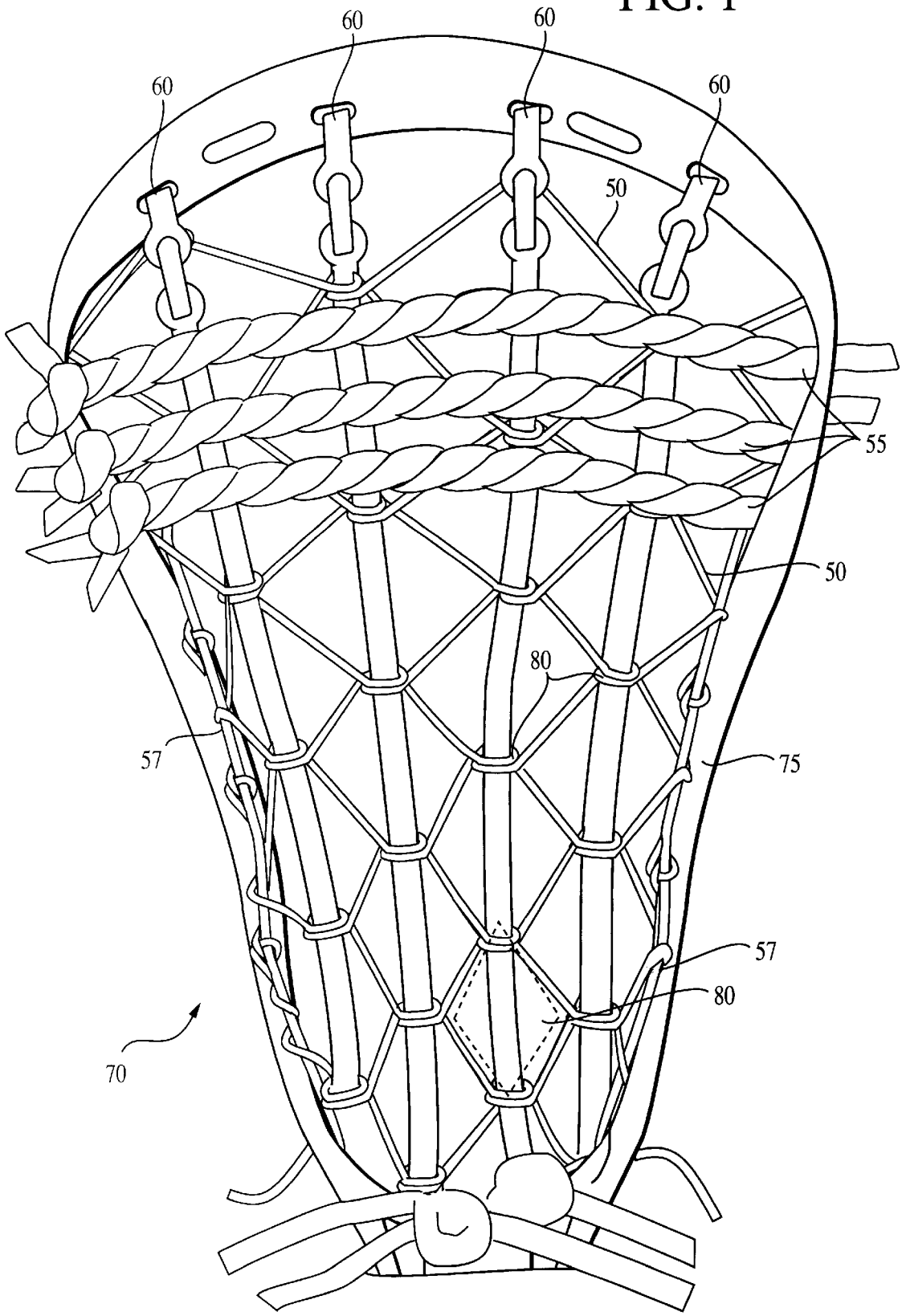
FIG. 1 is a head of a lacrosse stick strung with a traditional pocket.

A traditional pocket is explained because the present invention is a method and apparatus for stringing traditional pockets 70. As shown in FIG. 1, a traditional pocket 70 generally comprises an interlaced string 50, a shooting string 55, two side walls 57, and four thongs 60. The interlaced string 50 is preferably nylon, but can also be a variety of other natural or man-made materials. The thongs 60 are usually made of leather, but they may also be nylon or a variety of other natural or man-made materials.

Figure 2:
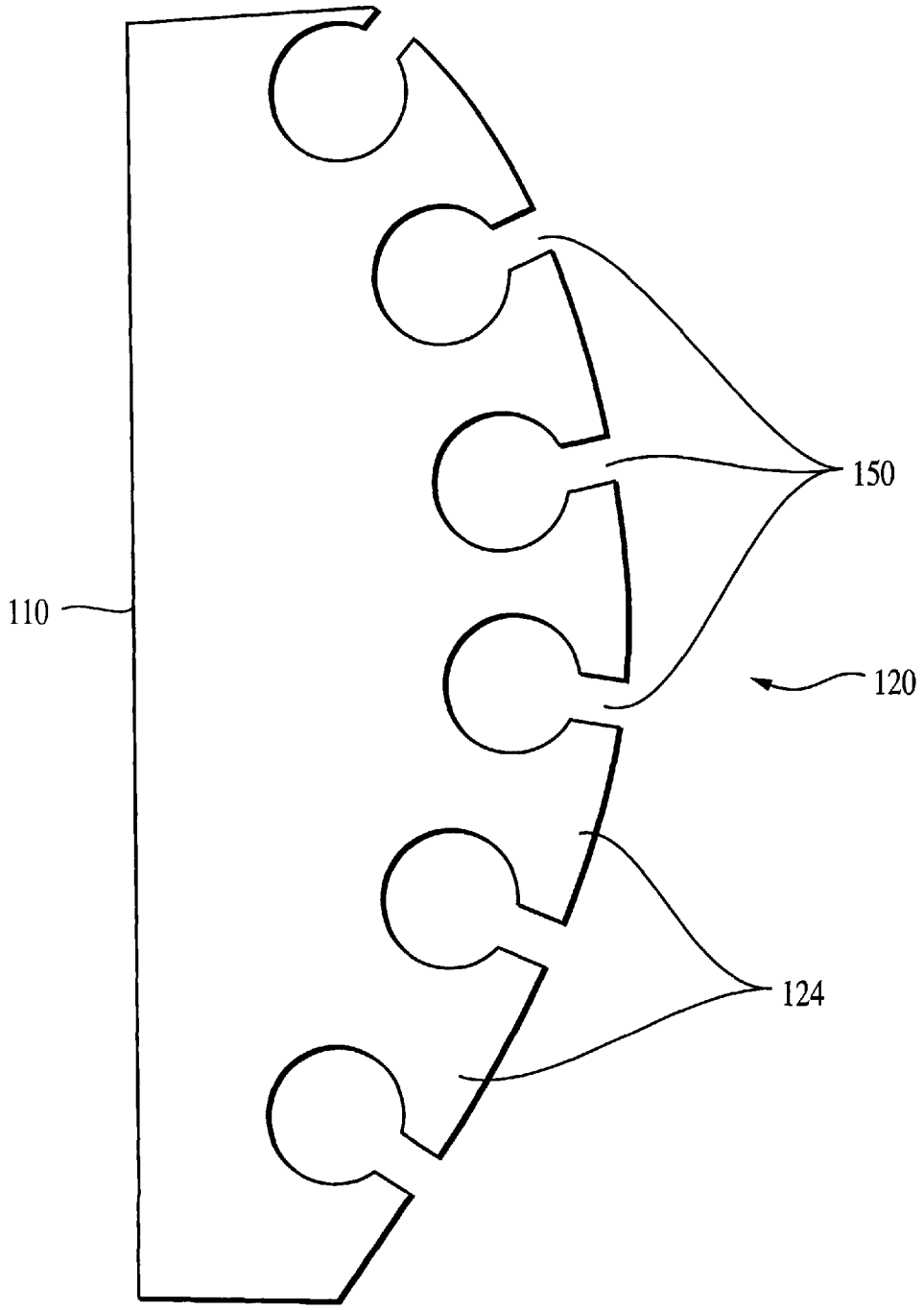
FIG. 2 is a side view of a guide.

The present invention is an apparatus and method for stringing the head 75 of a lacrosse stick with a traditional pocket 70 easier, and producing a higher quality traditional pocket 70. As shown in FIG. 2, the present invention can comprise a guide 110 with a plurality of notches 150.

The guides 110 can be made of metal, wood, plastic, or a variety of other materials. It is preferred the material be relatively stiff and rigid. The guides 110 usually have a front end, back end, flat side, curved side, and a plurality of T-shaped supports 124. A T-shaped support 124 is the portion of the guide 110 creating the notches 150. Preferably, a guide 110 is wider in the middle 120 than at the edges in order to make the shape of a pocket for a lacrosse stick, but the location of the widest portion 120 of a guide 110 may vary depending on where the user wants the ball (not shown) to rest in the pocket.

Figure 3:
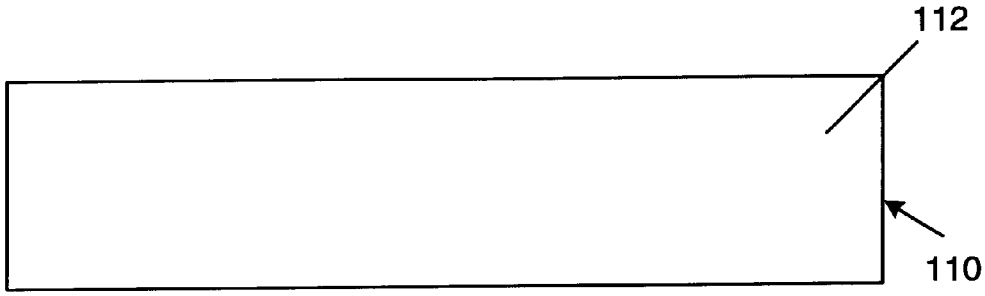
FIG. 3 is a bottom view of a guide.
Figure 4:
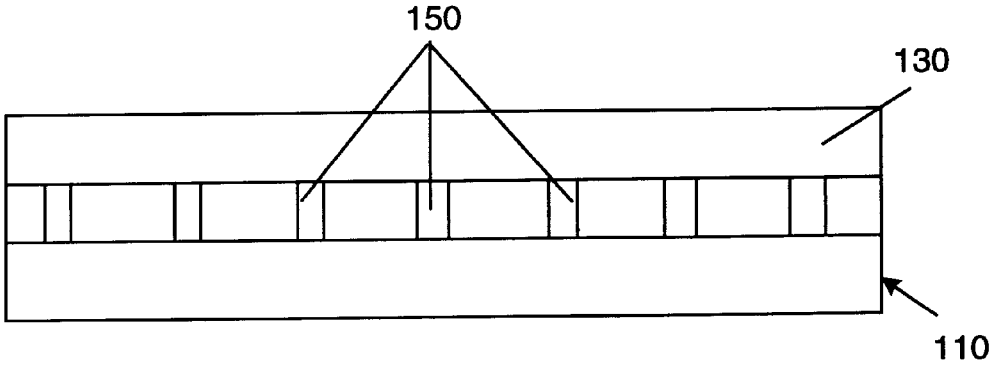
FIG. 4 shows the top view of a guide.
Figure 5:
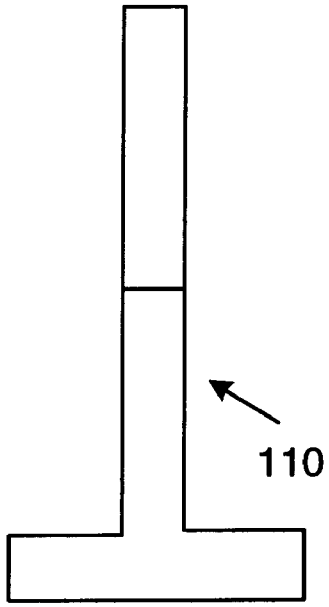
FIG. 5 shows a front view of a guide.
Figure 6:
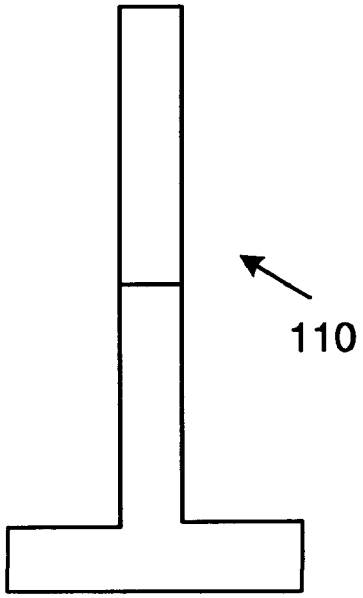
FIG. 6 shows a rear view of a guide.

As shown in FIG. 3, the bottom of a guide 110 is preferably rectangular. In the preferred embodiment, the bottom portion 112 of the guide 110 is probably an inch or two thick and four to nine inches long. In contrast, FIG. 4 shows the top portion 115 of the guide 110 which is preferably approximately an eighth of an inch thick or less. FIGS. 5 and 6 show a guide from a front and rear view, respectively.

The notches 150 on a guide 110 are preferably spaced evenly along the curved side of the guide 110, but the distance between the notches 150 may vary depending on where the user desires to interlace 80 the nylon 50 on the thongs 60 (i.e., the nylon placement), shown in FIG. 1. The spacing between the notches 150 on different guides 110 may also vary depending on the type of pocket the user prefers. The notches 150 are preferably small at the top to assure the nylon placement is consistent in every pocket. The bottom portion of the notches 150 are wider to enable the user to interlace the nylon at the desired nylon placement. In the preferred embodiment the wider portion of the notches 150 are circular, but in alternative embodiments the notches could have a variety of shapes, such as square, rectangular, hexagonal, or diamond.

Figure 7:
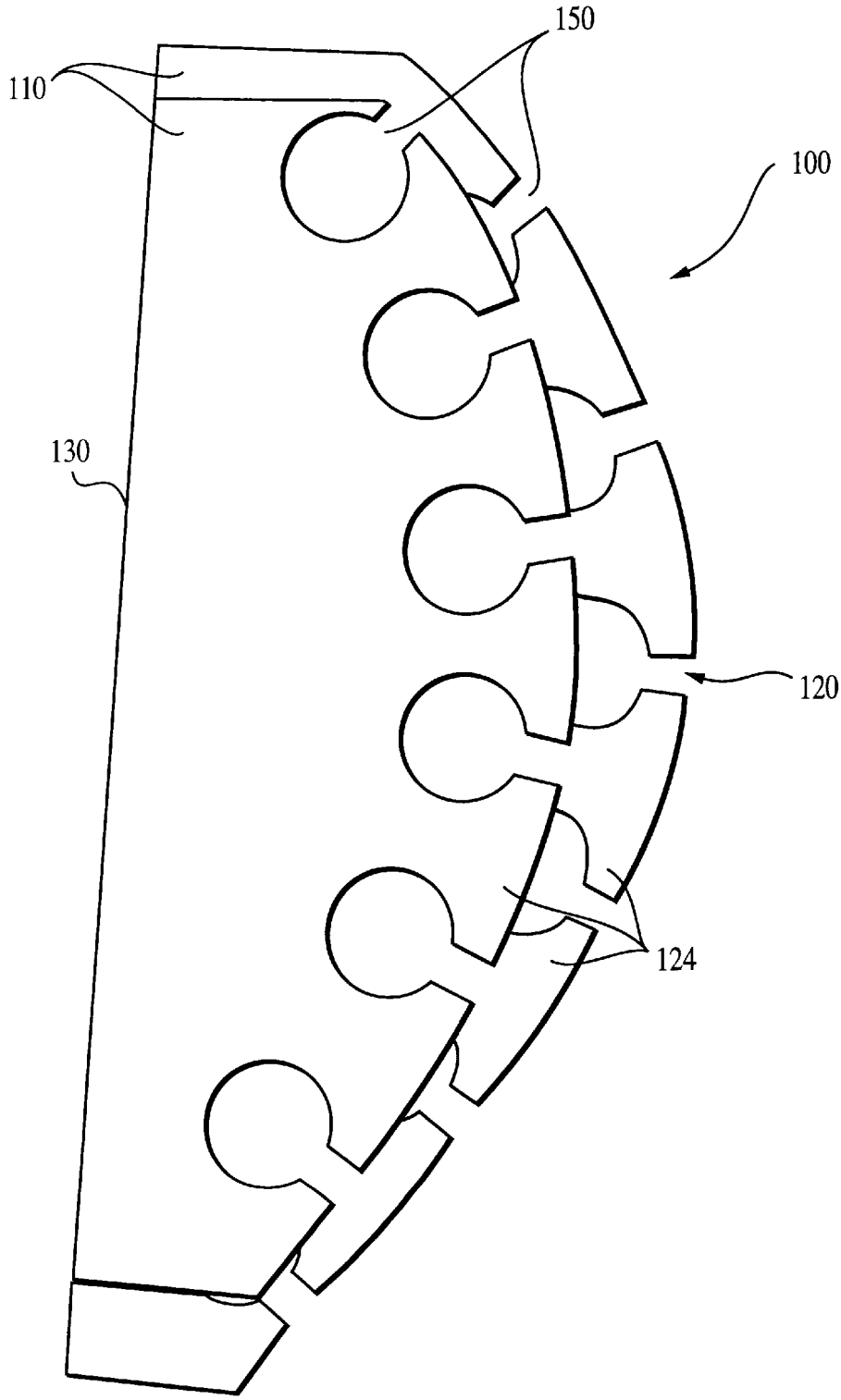
FIG. 7 is a side view of a pocket loom.
Figure 8:
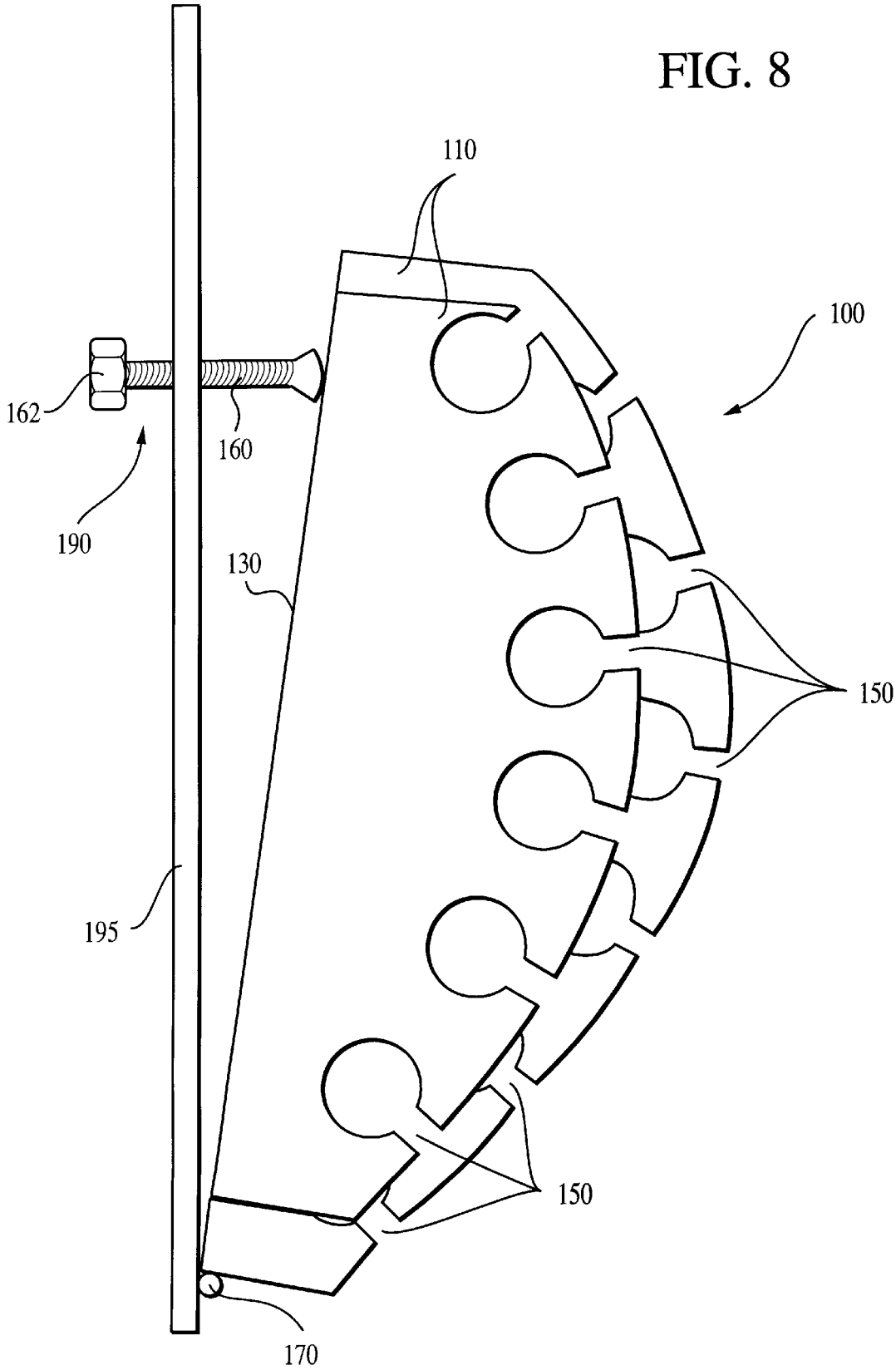
FIG. 8 is a side view of a pocket loom with a depth adjuster.
Figure 9:
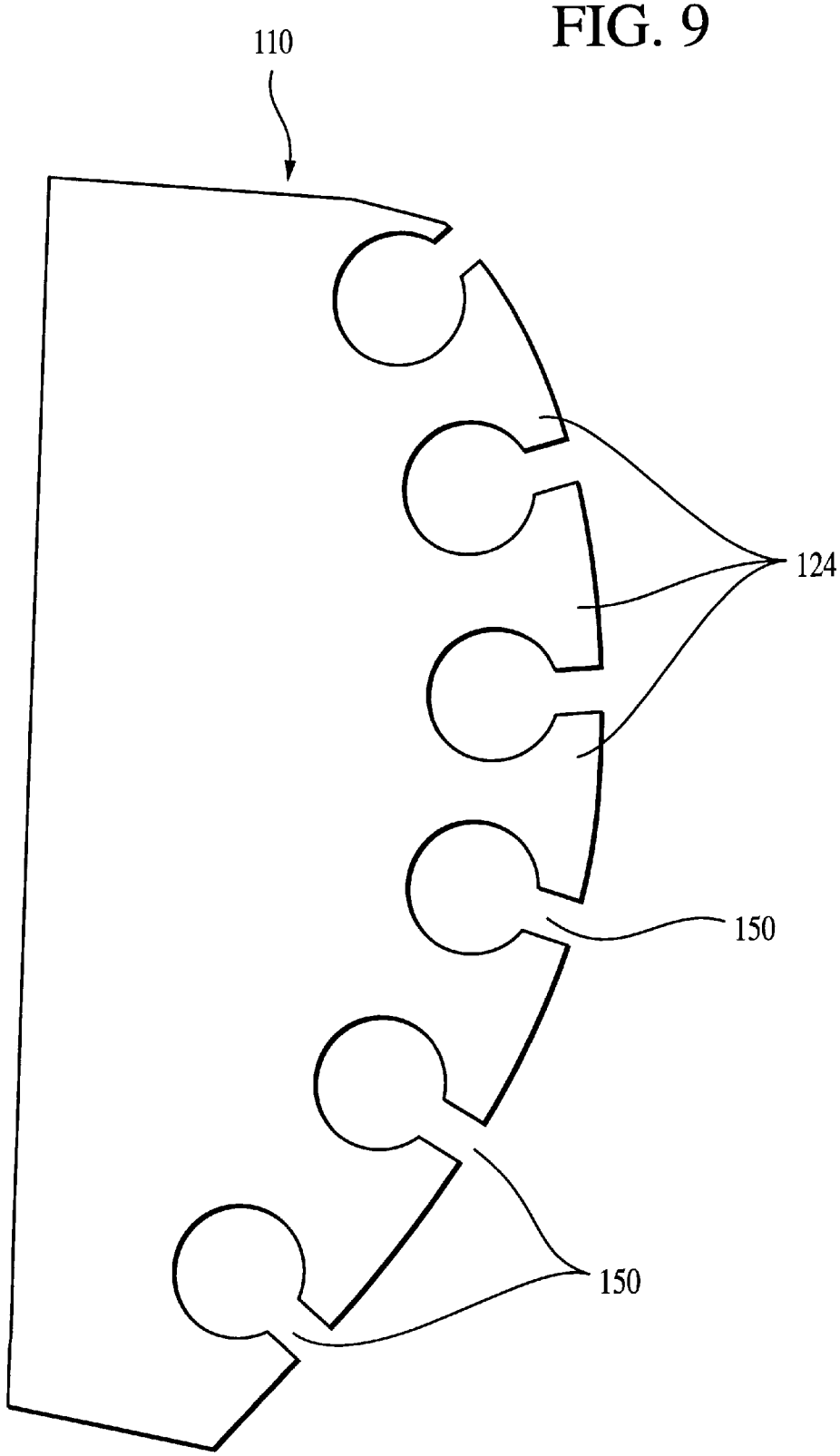
FIG. 9 is a side view of an alternative embodiment of the pocket loom.

As shown in FIG. 7, in the preferred embodiment, a plurality of guides 110 can be connected with a base 130 to form a pocket loom 100. FIG. 8 shows a pocket loom 100 with a depth adjuster 190. The depth adjuster 190 usually includes a hinge 170 and an adjustable arm 160. The hinge 170 allows the user to change the angle of the pocket loom 100 relative to the platform or working surface 195. In the preferred embodiment, the adjustable arm 160 is a screw and two nuts. One of the two nuts is not shown, but is located in the working surface 195. The other nut 162 is located at the end of the screw 160, opposite the head of the screw, to prevent the screw 160 from coming out of the working surface 195. By adjusting or turning the screw 160 into the nut 162, the front of the pocket loom 100 is lowered, decreasing the depth of the pocket created by the pocket loom 100 and reducing the angle between the base 130 and the working surface 195. By turning the screw 160 in the opposite direction, the front of the pocket loom 100 is raised, increasing the depth of the pocket made by the pocket loom 100 and increasing the angle between the base 130 on the working surface 195. In an alternative embodiments, the depth could be adjusted by simply propping the front of the pocket loom 100 up in relation to the back or changing the shape of the guides 110. As shown in FIG. 9, the guide 110 can be shaped at a desired angle without using the depth adjuster 190. An embodiment which may be preferable if the user always wants the same pocket.

Figure 10:
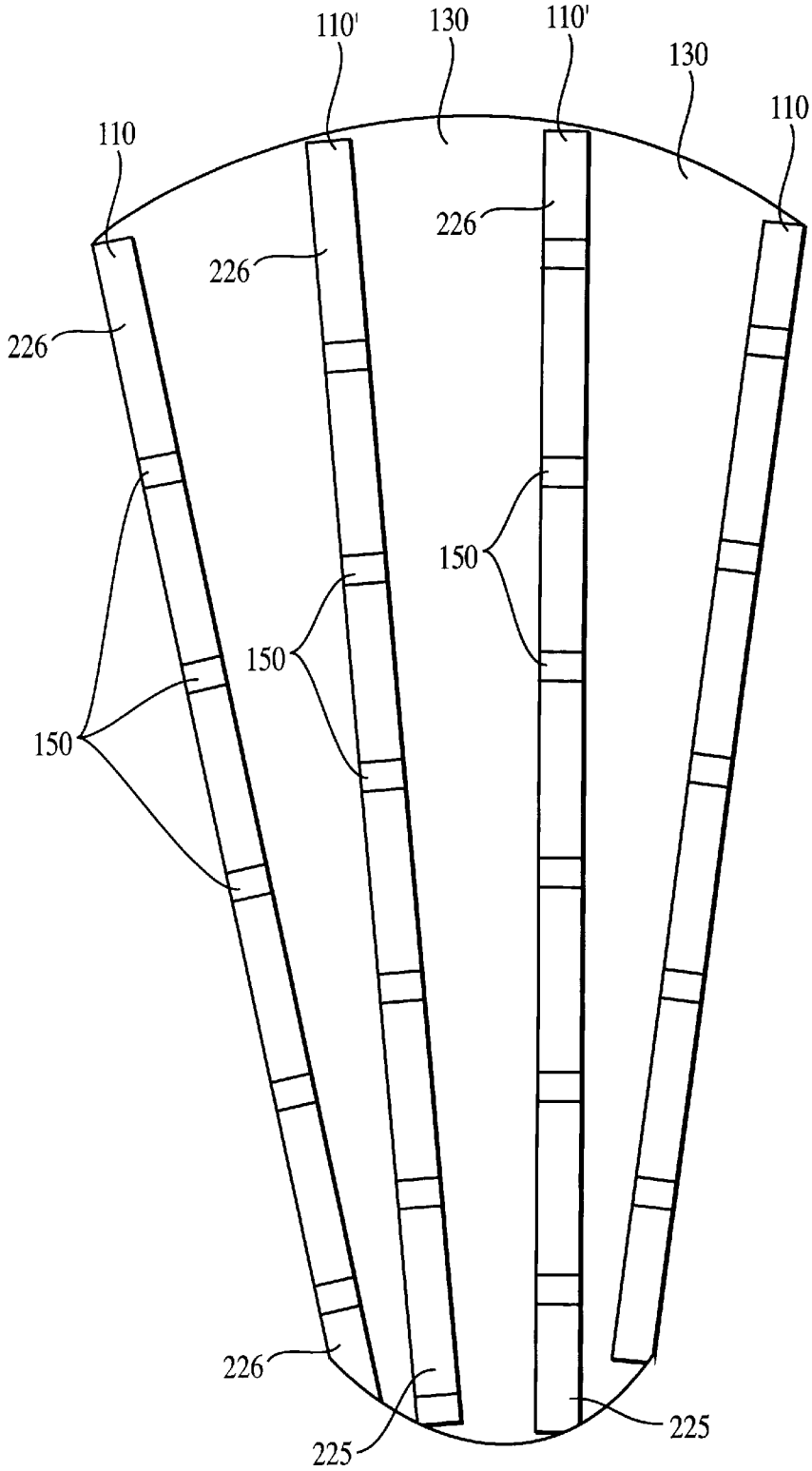
FIG. 10 is a top view of the preferred embodiment of the pocket loom.
Figure 11:
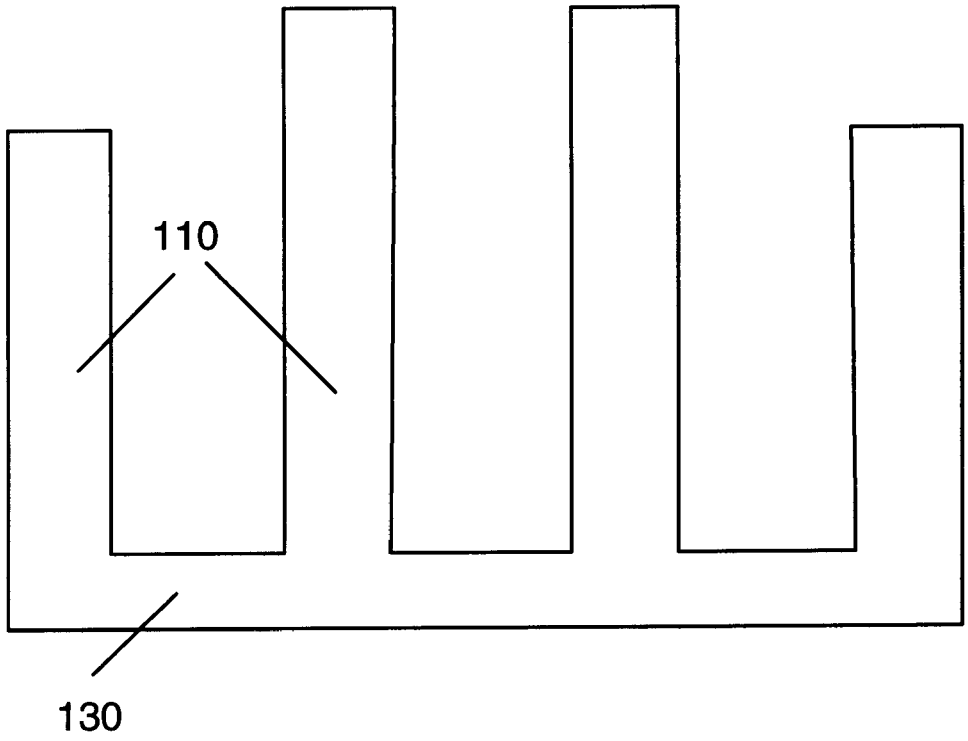
FIG. 11 shows a front view of a pocket loom.

As shown in FIG. 10, the preferred embodiment contains four guides 110, 110', and a base 130. However, in alternative embodiments, the pocket loom 100 may contain anywhere from two to six guides 110. In the preferred embodiment, the pocket loom 100 contains two inner guides 110' and two outer guides 110. The two inner guides 110' are generally equal in length (approximately eight and three-quarters inches), width (approximately two and one-half inches to four inches), and depth (approximately one eighth of an inch to one half inch). The back ends 225 of the two inner guides 110' are positioned slightly closer than the front ends 226 to replicate the position of the thongs 60 within a pocket.

The two outer guides 110 are a little shorter than the inner guides 110' (approximately eight inches), a little thinner (as shown in FIG. 7), and equal in depth. These two outer guides 110 are positioned on the outside of the two inner guides 110'. The back end 225 of the outer guide 110 is slightly closer to the back end 225 of its adjacent inner guide 110' than the front end 226 of the outer guide 110 is to the front end 226 of the inner guide 110', so that the guides 110, 110' converge towards the bottom of the pocket and diverge at the top.

Figure 12:
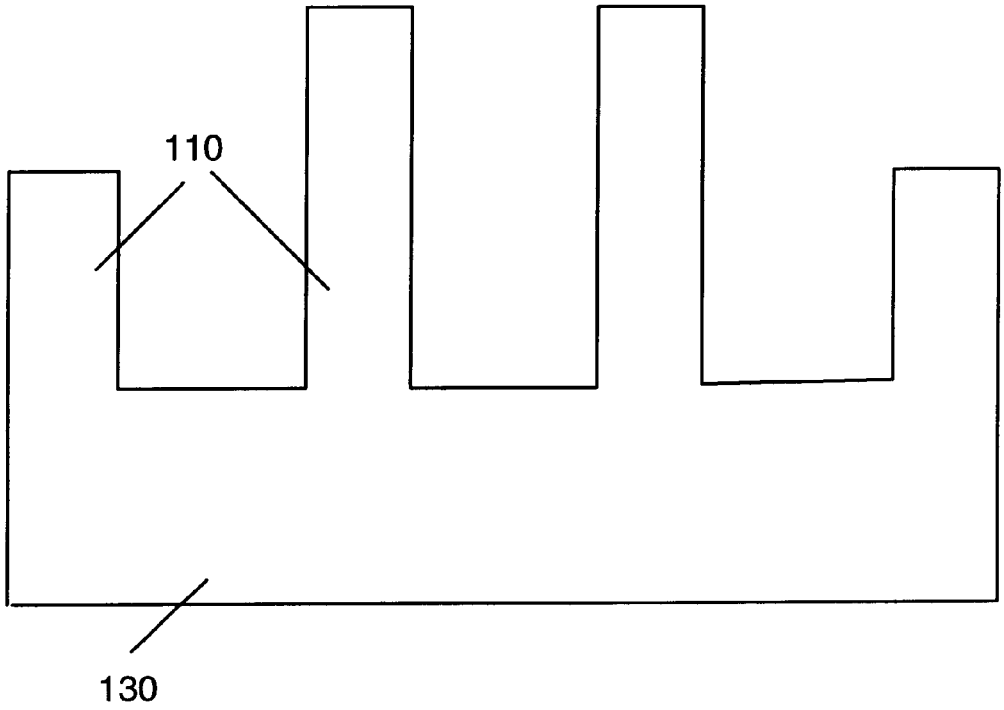
FIG. 12 shows a front view of an alternative embodiment of a pocket loom.

As shown in FIGS. 7, 8, 10 and 11 in the preferred embodiment, these guides 110, 110' are all connected by a base 130. The base 130 is used to maintain the position of the guides 110, 110' in relation to each other and improve the users ability to create the same pocket time after time. The base 130 also maintains the location of the notches 150 in one guide 110 to the notches 150 in the adjacent guides 110, 110'. As shown in FIG. 10, the notches 150 in one guide 110 are usually offset from its adjacent guides 110, 110'. The position of these notches 150 in relation to each other is important because they assist the user in creating the diamond shaped weave 80 (shown in FIG. 1) of a traditional pocket 70. An alternative embodiment is shown in FIG. 12, where the base 130 is thicker to add stability. In another embodiment, the guides 110 may slide into a base or fit into slots located at the top of the base. When connected in this manner, the guides 110, 110' are interchangeable within the same base 130. This allows for changing the shape of the pocket without changing the base 130.

Although the guides 110, 110' are usually attached in the form of a pocket loom 100, they may be used separately. The purpose of using them separately is to facilitate the user's ability to create a variety of customized pockets without using several pocket looms 100. For example, some lacrosse players desire deeper pockets than others. With separate guides, a user could simply replace the two inner guides 110' with wider inner guides and reuse the same outer guide 110 and create a wider pocket.

Figure 13A:
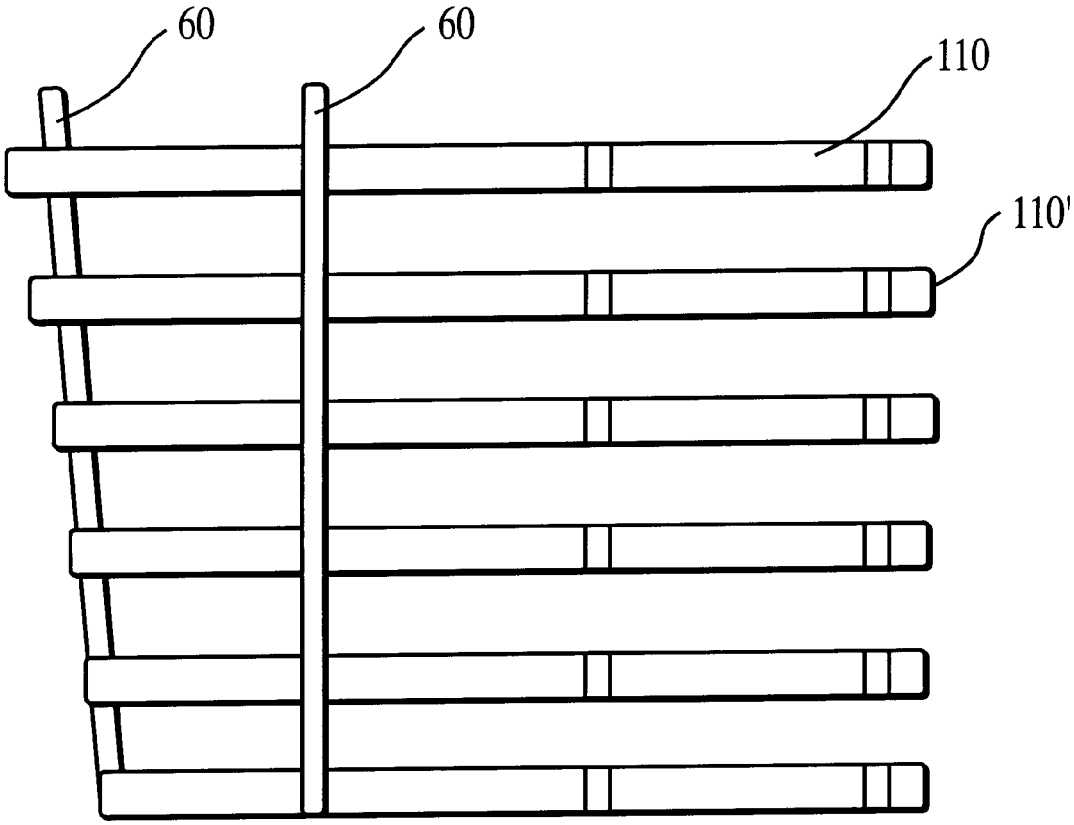
FIG. 13*a* shows a side view of an alternative embodiment with guides perpendicular to the thongs.
Figure 13B:
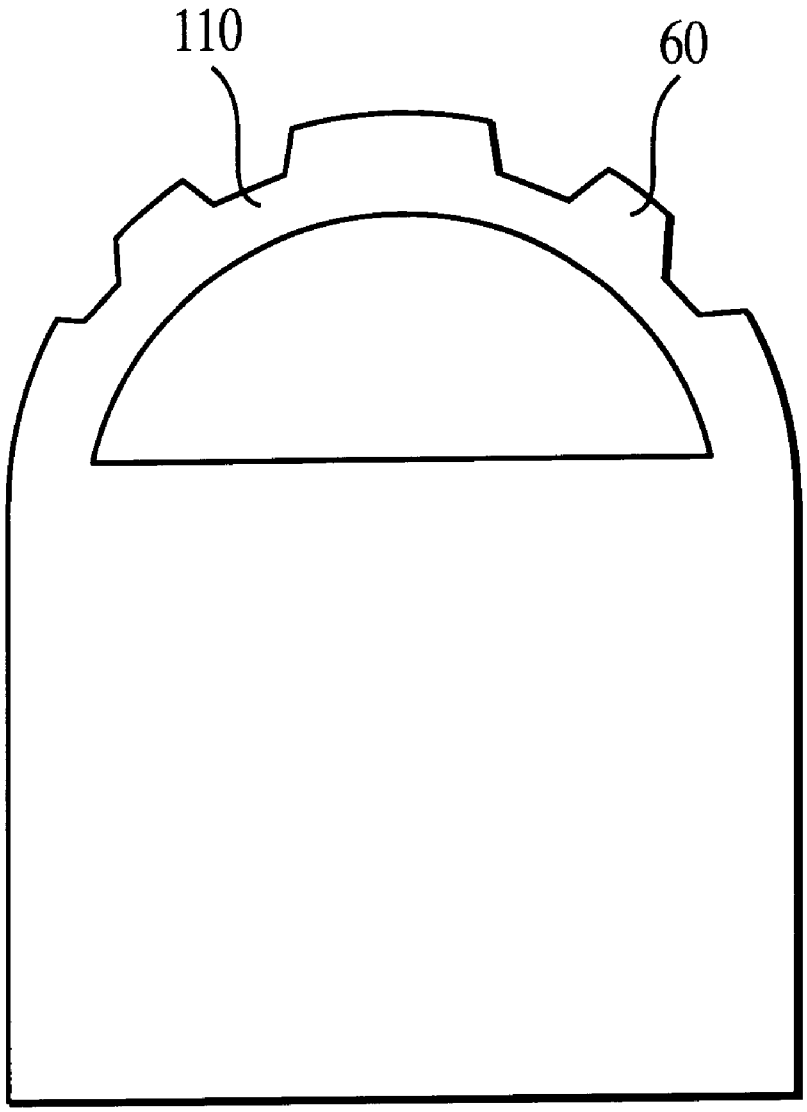
FIG. 13*b* shows a front view of an alternative embodiment with guides perpendicular to the thongs.

In an alternative embodiment, as shown in FIG. 13*a*, guides 110, 110' may also be positioned perpendicular to the thongs 60. In this embodiment, as shown in FIG. 13*b*, the guides 110, 110' are curved to resemble the shape of a pocket. The grooves are all aligned to hold a thong in the proper position to shape the pocket. The grooves holding the thongs at the bottom of the head are generally closer to replicate the slightly fan-shaped configuration of the thongs.

Figure 14:
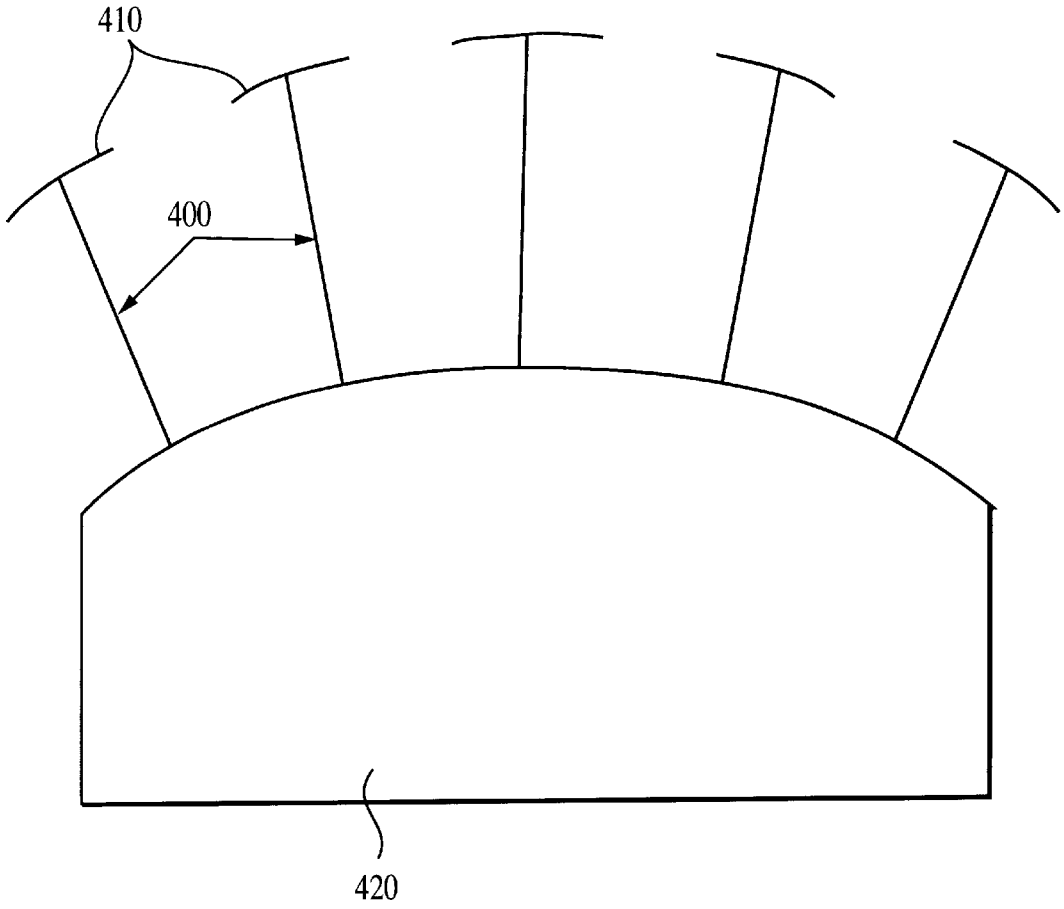
FIG. 14 shows an alternative embodiment for a guide using thong supports.

In another alternative embodiment, as shown in FIG. 14, guides may also be replaced with thong supports 400 connected by a frame 420. The thong supports 400 are used to support a thong. The thong supports 400 have flat ends 410 to hold the thongs in the shape of a pocket. The other end of the thong supports 400 are mounted in a frame 420 to maintain their position in relation to each other. The thong supports 400 can be fixed to the frame 420, or placed in holes within the frame 420 to make them removable or adjustable. If these thong supports 400 are removable, the user could insert different thong supports 400 within the same frame 420 to create different pockets. The number of thong supports 400 used and the length of the flat ends 410 may vary depending on the type of pocket desired by the user. The thong supports and frame can be made of a variety of rigid materials, including wood, plastic, and metal.

The space between the ends of the thong supports are preferably small to control the placement of the interlaces and wider at the bottom to permit the user enough room to interlace the nylon string. Similar to the notches, the chamber created between the thong spaces can be a variety of shapes.

Figure 15:
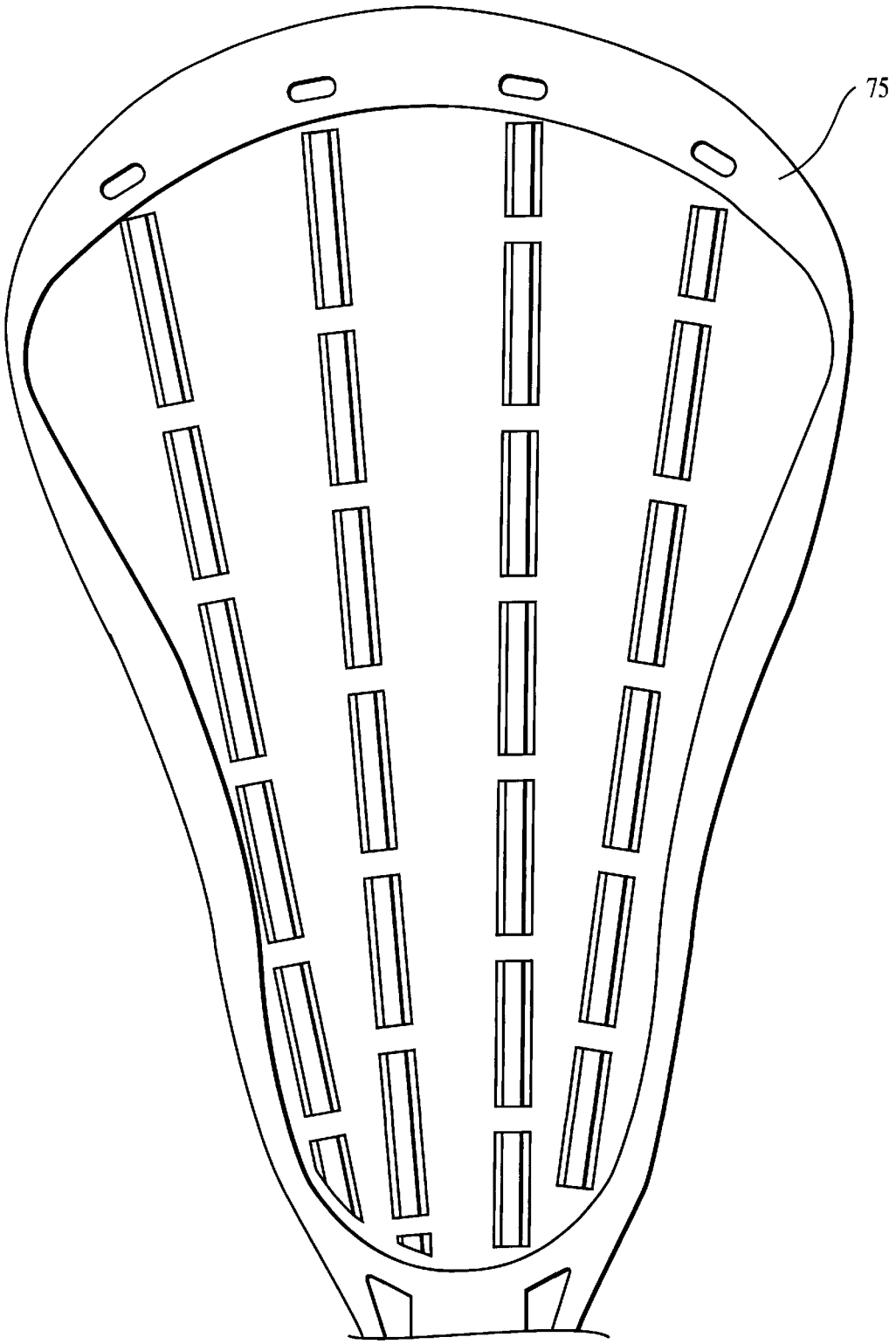
FIG. 15 is a top view of the present invention with an unstrung lacrosse stick head placed around it.
Figure 19:
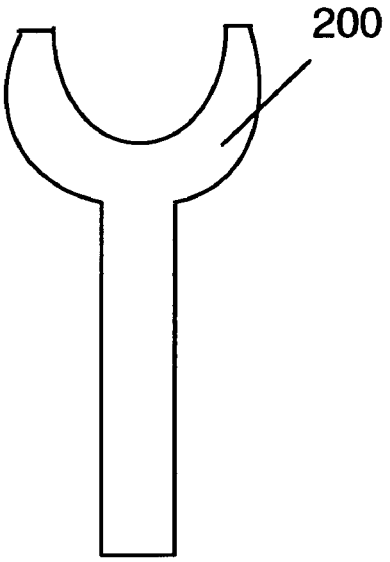
FIG. 19 is a front view of a guide with ridges.

To use the pocket loom 100 described above, as shown in FIG. 15, 16 and 19, the head 75 of a lacrosse stick, such as the head shown in U.S. Pat. No. 5,566,947, issued Oct. 22, 1996 under the name of Tucker et al., is placed over the curved side of the pocket loom 100 with the holes for the side walls facing up. U.S. Pat. No. 5,566,947 issued Oct. 22, 1996 and entitled LACROSSE STICK HAVING OPEN SIDE WALL STRUCTURE is incorporated herein by reference. As shown in FIG. 17, the side walls (not shown) and thongs 60 are usually already installed 620 or woven onto the head 75 before the head is placed 628 over or around the pocket loom 100, but they can also be installed after the head is placed over the pocket loom 100. The side walls are usually fixed in some manner to the base of the head. The side walls are for example, installed by tying a hitch knot or a variety of other types of knots at one end of the nylon string and inserting it through a hole in one side of the base of the head from the outside of the head. That side wall or string is then fed into the adjacent hole from the inside of the head. Next, the side wall is threaded 620 behind the portion of side wall between the first and second holes, before being threaded into the third hole from the inside of the head. To install the side wall, this procedure is continued until the side wall reaches the top of that side of the head and is fixed or tied off with a knot. Similarly, another side wall is installed on the opposite side of the head.

Figure 18:
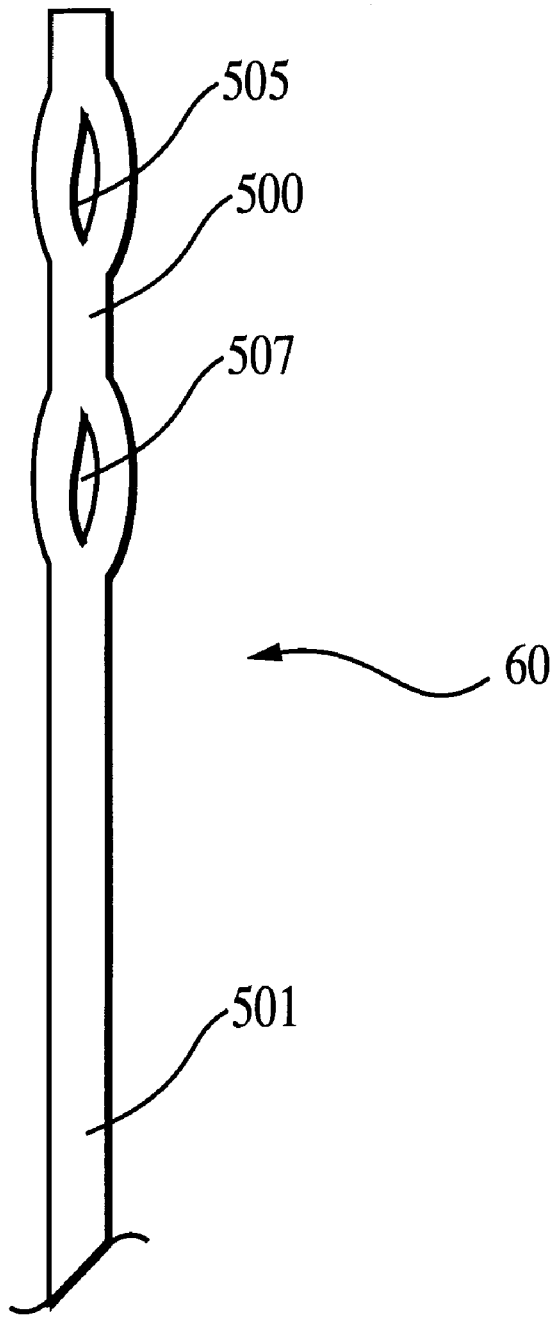
FIG. 18 shows a thong with two holes.

As for the installation of a thong 60, as shown in FIG. 18, about a two inch portion 500 of the thong 60 with two holes 505, 507 cut in the middle of it, is inserted through one of the four holes at the top of the head. The two inch portion 500 is then double backed toward the bottom of the head. Then the other portion 501, usually at least nine inches long, is threaded through the first hole 507 in the two inch portion, then it is weaved back through the second hole 505 (to prevent the end of the two inch portion from interfering with the performance of the stick). Then the long portion 501 is threaded into a hole at the bottom of the head corresponding to the same hole in the top of the head. Once the thong 60 is threaded through the hole at the bottom of the head, the long portion 501 can be tied off with a hitch knot or other type of knot. Depending on the depth of the pocket desired, some slack should be left in the thong 60 before tying it off at the bottom of the head. For another description of the installation of the side walls and the thongs, see U.S. Pat. No. 4,861,042, issued on Aug. 29, 1989 in the name of Douglas F. Trettin, incorporated herein by reference.

Figure 16:
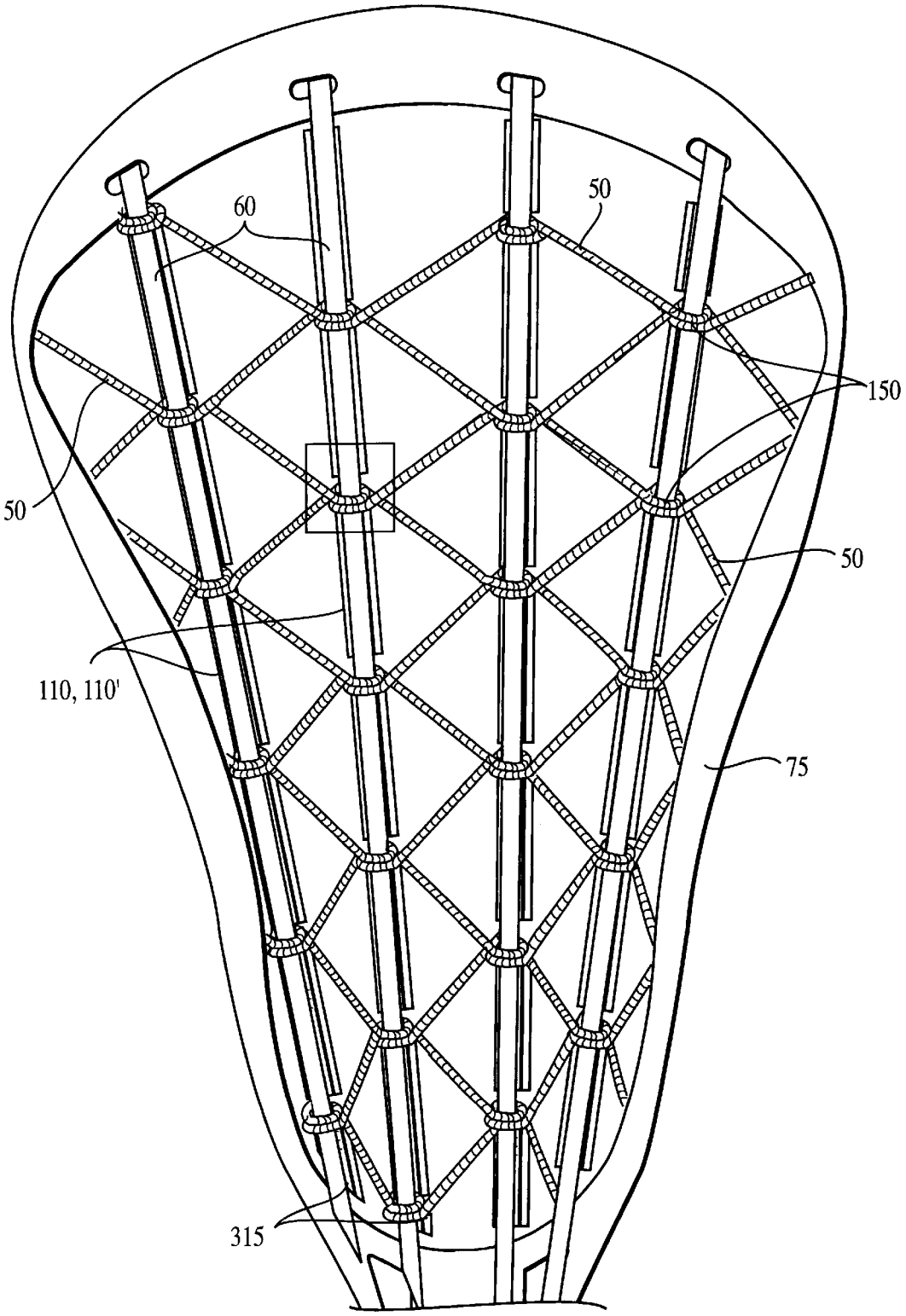
FIG. 16 is a top view of the present invention with a strung lacrosse stick head placed around it. The side walls and shooting strings are not shown.
Figure 17:
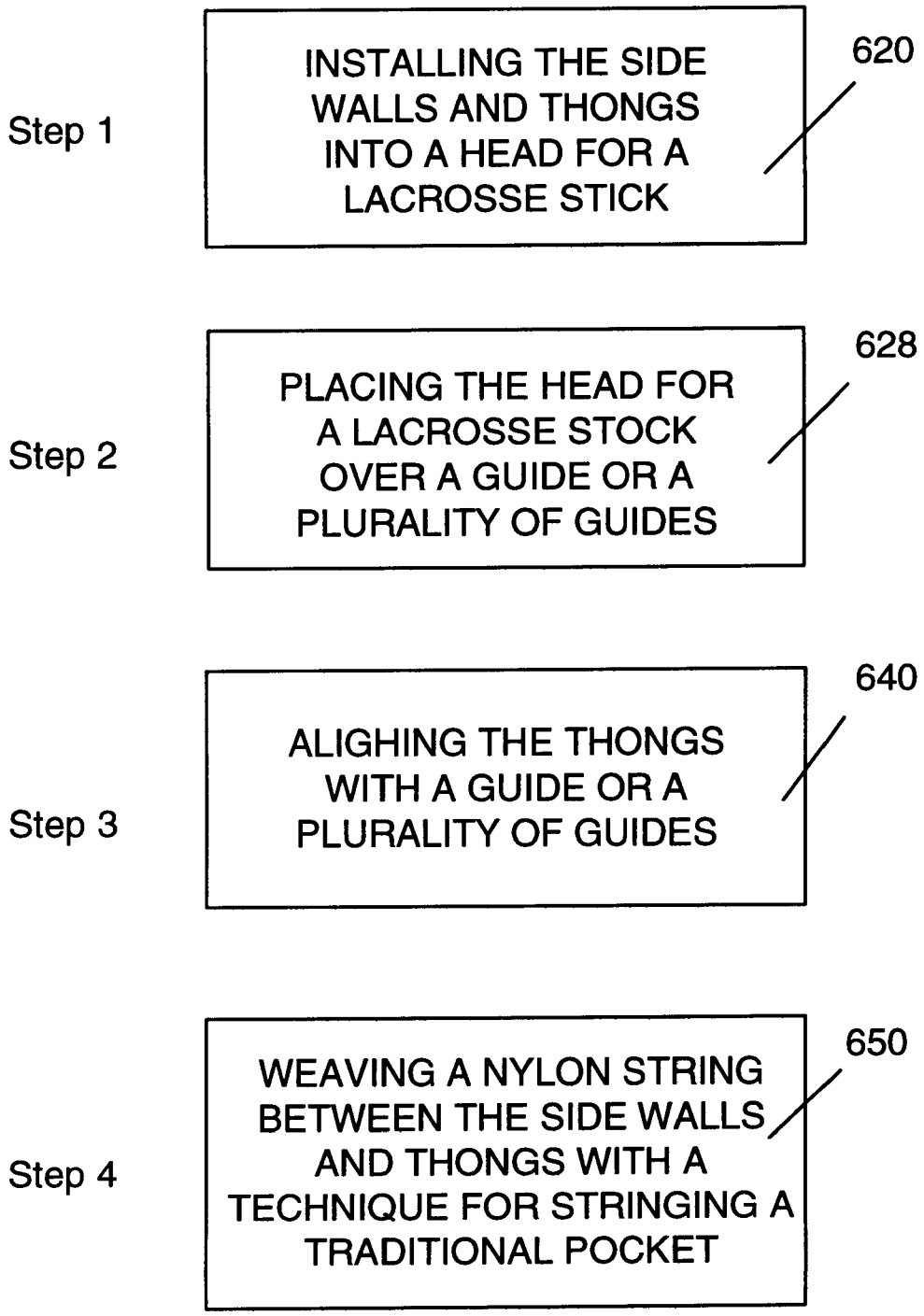
FIG. 17 shows a flow diagram of the preferred steps for using the present invention.
Figure 20:
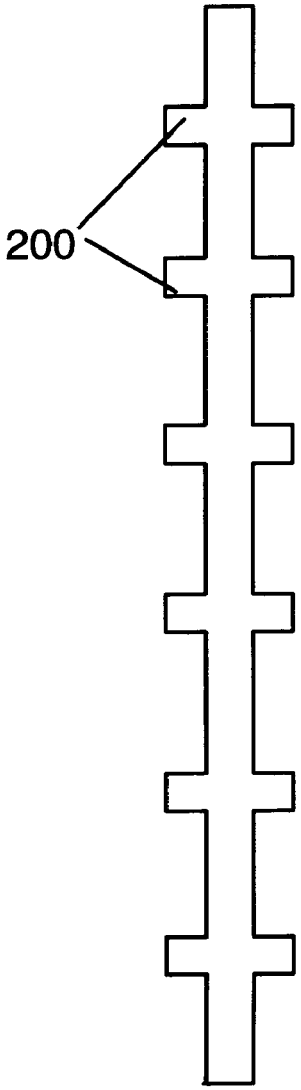
FIG. 20 is a top view of a guide with ridges.

The thongs 60 should be attached loosely until they are aligned 640 with the guides 110, 110' as shown in FIG. 16, at the desired pocket depth and shape. When the thongs are positioned at the depth desired by the user, the user should tie the bottom ends 315 of the thongs 60 so they do not slip during stringing. During stringing, the thongs 60 may also be held from slipping by the means for securing 200, such as the ridges shown in FIG. 19 and 20, ties, or clips. A ridge may run the entire length of the guide 110. However, a means for securing 200 is not required if the bottom ends 315 of the thongs 60 are tied tightly against the guides 110, 110' because friction will stop the thongs 60 from slipping.

Once the thongs 60 are aligned with the guides 110, 110' as shown in FIG. 16, the user can weave 650 the nylon 50 between the side wall (not shown) and the thongs 60 to create a pocket. One technique of weaving the nylon 50 in this manner is shown in U.S. Pat. No. 4,861,042 (incorporated herein by reference). The nylon placements are made where the notches 150 on the guides 110 110' are located. As stated earlier, the notches 150 are wider at the bottom to give the weaver more room.

With a traditional-style pocket, the person stringing the pocket usually starts weaving the nylon 50 from the bottom of the head 75 between a side wall 57 and its adjacent thong 60. When the nylon 50 reaches the top of the head 75, the nylon 50 is weaved between the first thong 60 and the second thong 60 toward the bottom of the head 75. This procedure is continued until the nylon 50 reaches the top of the head 75 on the opposite side from the starting place.

Figure 21:
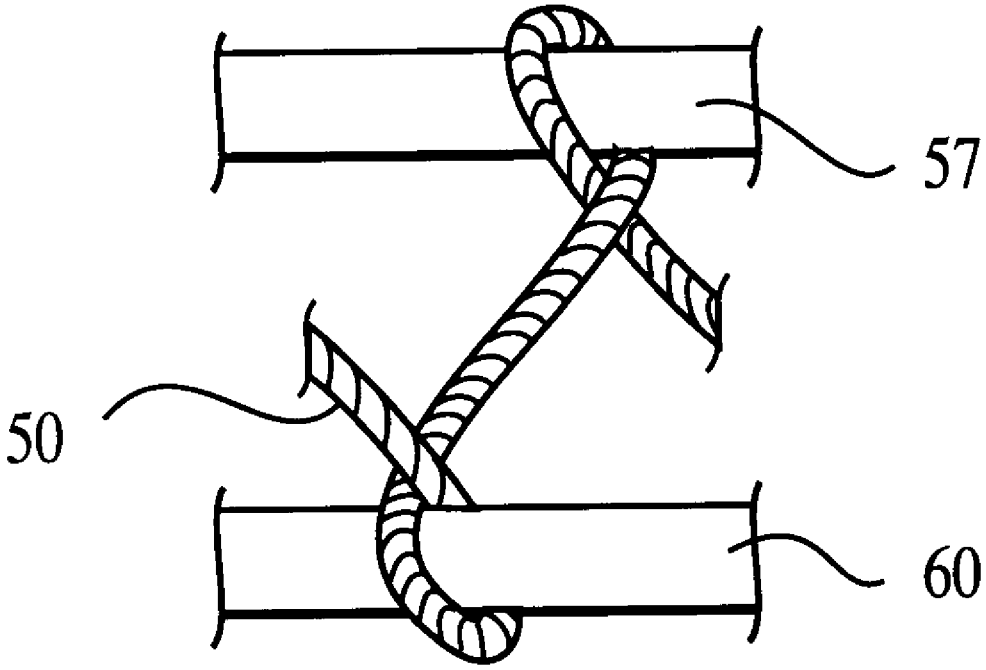
FIG. 21 shows a technique of weaving a nylon string between a side wall and a thong.

The weaving is started by fixing or tying a hitch knot or other knot in one end of the nylon string. Then, the nylon is threaded through a hole on one side on the bottom of the head, like a side wall weave. Next, as shown in FIG. 21, the nylon 50 is woven around the outer thong 60. After the nylon string 50 is wrapped completely around the outer thong 60, it is threaded behind and under itself. Next, the nylon string 50 is woven around the side wall 57 in the same manner. Using this technique, the nylon 50 alternates between the outer thong 60 and the side wall 57 until it reaches the top. How many times it alternates depends on how many notches are in the guide supporting that thong 60.

Figure 22A:
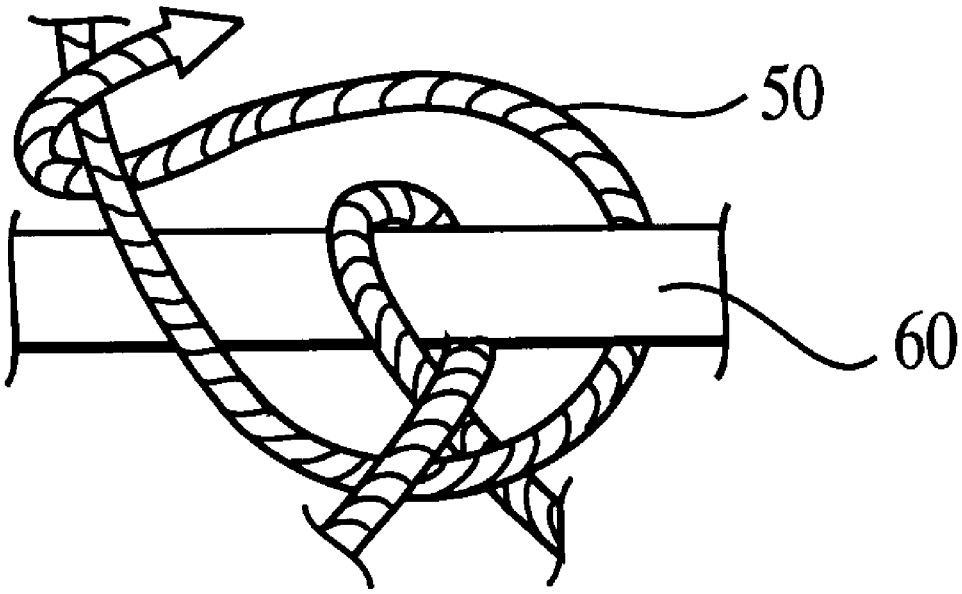
FIG. 22*a* shows a technique of interlacing a nylon string.
Figure 22B:
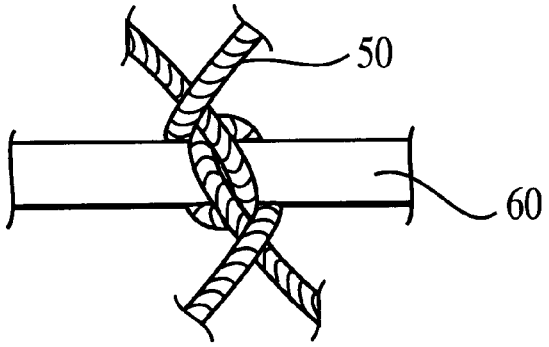
FIG. 22*b* shows the results of interlacing a nylon string.

When the nylon string reaches the top of the head 75, the user repeats the same procedure between the outer thong and the inner thong until it reaches the bottom/base of the head. The only differences is that when the nylon string 50 is woven around the outer thong 60 on the way back down, it is interlaced with itself, as shown in FIG. 22*a*. The results of the interlaced nylon string 50 is shown in FIG. 22*b*. The nylon string 50 that is woven into the pocket may be one piece or several pieces of nylon string.

Figure 23:
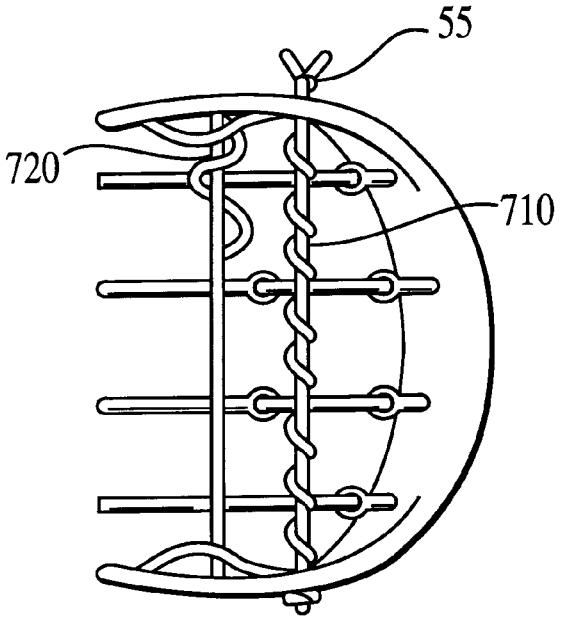
FIG. 23 shows a technique for weaving a shooting string.

This procedure is continued between the first and second inner thongs, then between the second inner thong and the second outer thong, and then between the second outer thong and the second side wall. After the nylon weaving is complete, the user can install the shooting strings. As shown in FIG. 23, the shooting string 55 is a nylon string braided across the top part of the head 75. Usually, the shooting string 55 is first braided 710 from one side of the head to the other, and then back in parallel about a half an inch above or below the first pass. The shooting string 55 usually controls the release of the ball.

The foregoing description of the present invention has been presented for purposes of illustration and description. The description is not intended to limit the invention to the forms described. Variations and modifications commensurate with the above teachings, and within the skill and knowledge of the relevant art, are part of the scope of the present invention.

What is claimed is:

1. An apparatus for stringing a pocket in a head of a lacrosse stick, the pocket including at least one thong, the apparatus comprising:

a guide having:

a plurality of notches capable of passing through pocket string during the stringing of a head of a lacrosse stick; and a plurality of supports capable of supporting a thong during the stringing of a pocket in a head of a lacrosse stick.

2. The apparatus of claim 1, wherein the plurality of notches are un-evenly spaced.

3. The apparatus of claim 1, wherein the plurality of supports include a ridge that secures the thong to the supports.

4. An apparatus for stringing a pocket in a head of a lacrosse stick, the pocket including at least one thong, the apparatus comprising:

a guide having:

a plurality of notches; and a plurality of supports that support a thong during the stringing of a pocket in a head of a lacrosse stick; and a base, wherein one or more guides are connected by the base.

5. The apparatus of claim 1, wherein the notches in the guides are spaced to enable a diamond shaped weave to be created.

6. The apparatus of claim 1, further comprising a depth adjuster.

7. The apparatus of claim 1, wherein the guide has two ends, and wherein one end is higher than the other end.

8. The apparatus of claim 1, wherein the plurality of supports form a curve.

9. The apparatus of claim 1, wherein a portion of at least one of the notches is circular.

10. The apparatus of claim 1, wherein at least one of the plurality of supports is T-shaped.

11. The apparatus of claim 1, wherein there are more supports than there are notches.

12. The apparatus of claim 1, wherein each support supports a thong during the stringing of a pocket in a head of a lacrosse stick.

13. The apparatus of claim 1, wherein the plurality of supports support more than one thong during the stringing of a pocket in a head of a lacrosse stick.

14. The apparatus of claim 1, wherein the notches are evenly spaced.

15. The apparatus of claim 1, wherein the supports include ridges that secure the thong to the supports.

16. The apparatus of claim 13, wherein each support supports a different thong.

17. The apparatus of claim 1, wherein the plurality of notches have a top and a bottom, and wherein the plurality of notches are more narrow at the top than the bottom.

18. An apparatus for stringing a pocket in a head of a lacrosse stick, the apparatus comprising:

a guide having a plurality of notches, whereby the guide supports a thong during the stringing of a head of a lacrosse stick, wherein the guide has a middle and two ends, and wherein the middle is wider than the two ends.

19. An apparatus for stringing a pocket in a head of a lacrosse stick, the apparatus comprising:

a guide having a plurality of notches, whereby the guide supports a thong during the stringing of a head of a lacrosse stick; and, a depth adjuster.

20. The apparatus of claim 19, wherein the depth adjuster includes a hinge and an adjustable arm.

21. An apparatus for stringing a pocket in a head of a lacrosse stick, the apparatus comprising:

a guide having a plurality of notches, whereby the guide supports a thong during the stringing of a head of a lacrosse stick; and, wherein the guide has two ends, and wherein one end is higher than the other end.

22. An apparatus for stringing a pocket in a lacrosse stick, comprising:

a base;

two inner guides, connected to the base, with each inner guide having a plurality of notches and supports; and two outer guides with each outer guide having a plurality of notches, wherein each outer guide is connected to the base adjacent to an inner guide.

23. The apparatus of claim 22, wherein the plurality of notches in the inner guides are offset from the plurality of notches in the outer guides to create a diamond pattern.

24. The apparatus of claim 22 further comprising a depth adjuster connected to the base.

25. The apparatus of claim 24, wherein there is an angle between at least one of the guides and the base and the depth adjuster allows this angle to be changed.

26. A method of stringing a head of a lacrosse stick comprising the steps of:

installing a side wall and a thong into the head;

aligning the thong with a guide;

placing the head of the lacrosse stick over the guide according to the alignment of the thong with the guide; and weaving an interlace string between the side wall and the thong.

27. A method for stringing a pocket in a lacrosse stick with an interlace string and a thong, comprising the step of utilizing an apparatus comprising:

means for supporting the thong in shape of the pocket; and means for permitting an interlace string to be interlaced around the thong.

28. The method of claim 27 wherein the apparatus further comprises a means for securing the thong to the means for supporting the thong.

29. The method of claim 27, wherein the means for supporting comprises a groove.

30. The method of claim 27, wherein the means for supporting comprises grooves.

31. The method of claim 27, wherein the means for supporting comprises thong supports.

32. The method of claim 27, wherein the supporting means is perpendicular to the thong.

33. The method of claim 27, wherein the supporting means supports more than one thong.

34. The method of claim 27, wherein the supporting means comprises at least one guide.

35. The method of claim 27, wherein the means for permitting comprises one or more notches.

36. The method of claim 27, wherein the supporting means has a plurality of notches.

37. An apparatus for stringing a pocket in a lacrosse stick with an interlace string and a thong, the apparatus comprising:

means for supporting the thong in shape of the pocket; and means for permitting an interlace string to be interlaced around the thong, wherein the supporting means comprises at least one guide that has a middle and two ends and the middle is wider than the two ends.

38. An apparatus for stringing a pocket in a lacrosse stick with an interlace string and a thong, the apparatus comprising:

means for supporting the thong in shape of the pocket;

means for permitting an interlace string to be interlaced around the thong; and a depth adjuster.

39. An apparatus for stringing a pocket in a head of a lacrosse stick, the pocket including at least one thong, the apparatus comprising:

a guide having:

a plurality of notches; and a plurality of supports that support a thong during the stringing of a pocket in a head of a lacrosse stick, wherein the guide has a middle and two ends, and wherein the middle is wider than the two ends.

* * * * *